US009834334B2

(12) United States Patent
Yoshifusa et al.

(10) Patent No.: US 9,834,334 B2
(45) Date of Patent: Dec. 5, 2017

(54) CARGO PALLET

(71) Applicants: Katsutoshi Yoshifusa, Chou-ku, Tokyo (JP); Hirotaka Yoshifusa, Chuo-ku, Tokyo (JP); Kark K. Yoshifusa, Lake Forest, CA (US); G.E.S. CO., LTD., Chuo-ku, Tokyo (JP); SMART STYLE JAPAN CO., LTD., Chiyoda-ku, Tokyo (JP)

(72) Inventors: Katsutoshi Yoshifusa, Tokyo (JP); Hirotaka Yoshifusa, Tokyo (JP)

(73) Assignees: Katsutoshi Yoshifusa, Tokyo (JP); Hirotaka Yoshifusa, Tokyo (JP); Kark K. Yoshifusa, Lake Forest, CA (US); G.E.S. CO., LTD., Tokyo (JP); SMART STYLE JAPAN CO., LTD., Tokyo (JP)

( * ) Notice: Subject to any disclaimer, the term of this patent is extended or adjusted under 35 U.S.C. 154(b) by 0 days.

(21) Appl. No.: 15/289,863

(22) Filed: Oct. 10, 2016

(65) Prior Publication Data

US 2017/0107013 A1 Apr. 20, 2017

(30) Foreign Application Priority Data

Oct. 16, 2015 (JP) ..... 2015-205001

(51) Int. Cl.

*B65D 19/38* (2006.01)
*B65D 19/00* (2006.01)
*B65D 81/02* (2006.01)

(52) U.S. Cl.

CPC ..... *B65D 19/0069* (2013.01); *B65D 19/0012* (2013.01); *B65D 19/0028* (2013.01); *B65D 19/38* (2013.01); *B65D 81/02* (2013.01); *B65D 2519/00034* (2013.01); *B65D 2519/00069* (2013.01); *B65D 2519/00104* (2013.01); *B65D 2519/00273* (2013.01);

(Continued)

(58) Field of Classification Search

CPC ..... B65D 19/0069; B65D 19/0053; B65D 19/0055; B65D 19/0067; B65D 19/38; B65D 19/40; B65D 2519/0034; B65D 2519/00069; B65D 2519/00104; B65D 2519/00273; B65D 2519/00288; B65D 2519/00303; B65D 2519/00318; B65D 2519/00358; B65D 2519/00373

See application file for complete search history.

(56) References Cited

U.S. PATENT DOCUMENTS 2,091,918 A * 8/1937 Finck ..... E04B 1/806 181/291
5,672,412 A * 9/1997 Phares ..... B32B 3/28 108/51.3

(Continued)

FOREIGN PATENT DOCUMENTS

JP H08175544 A 7/1996

*Primary Examiner* — Daniel J Rohrhoff

(74) *Attorney, Agent, or Firm* — Law Office of Katsuhiro Arai

(57) ABSTRACT

A cargo pallet made of synthetic resin includes: a top plate and a bottom plate, each plate constituted by bonded stacked synthetic-resin boards cut into a specified shape and size; and spacers bonded between the top plate and the bottom plate which are arranged in parallel and separated by the spacers. Each board is constituted by two sheets with an inner cavity layer interposed between the two sheets. In an embodiment, ribs connecting the two sheets of one board are aligned in parallel in a first direction, and ribs connecting the two sheets of another board stacked on the one board are aligned in parallel in a second direction which is perpendicular to the first direction. The spacers are elastic spacers made of synthetic resin and having spring elasticity in a height direction.

8 Claims, 9 Drawing Sheets

(52) U.S. Cl.
CPC ..... *B65D 2519/00288* (2013.01); *B65D 2519/00293* (2013.01); *B65D 2519/00303* (2013.01); *B65D 2519/00318* (2013.01); *B65D 2519/00323* (2013.01); *B65D 2519/00338* (2013.01); *B65D 2519/00343* (2013.01); *B65D 2519/00358* (2013.01); *B65D 2519/00373* (2013.01); *B65D 2519/00378* (2013.01); *B65D 2519/00562* (2013.01)

(56) References Cited

U.S. PATENT DOCUMENTS

| | | | | |
|---|---|---|---|---|
| 5,799,584 | A * | 9/1998 | Campbell | B65D 19/0026 108/51.3 |
| 6,817,586 | B1 * | 11/2004 | Lin | B65D 19/0026 248/346.02 |
| 2003/0183133 | A1 * | 10/2003 | Dehennau | B65D 19/0012 108/57.25 |
| 2004/0009332 | A1 * | 1/2004 | Tanaka | B32B 29/08 428/184 |
| 2006/0130712 | A1 * | 6/2006 | Wang | B65D 19/0075 108/57.25 |
| 2006/0207481 | A1 * | 9/2006 | McCarthy | B65D 19/0026 108/51.3 |
| 2006/0236899 | A1 * | 10/2006 | Nelson | B65D 19/0012 108/51.3 |
| 2007/0022920 | A1 * | 2/2007 | Suh | B65D 19/0012 108/57.34 |
| 2008/0087203 | A1 * | 4/2008 | Hartel | B65D 19/0012 108/57.31 |
| 2010/0062233 | A1 * | 3/2010 | Cohen | B27N 3/007 428/212 |

* cited by examiner

CARGO PALLET

BACKGROUND

Field of the Invention

The present invention relates to a cargo pallet, and more specifically to a cargo pallet made of synthetic resin that can be manufactured in an affordable, efficient manner.

Description of the Related Art

Commonly used cargo pallets include wood pallets that are normally formed entirely of wood, including the top plate, bottom plate, and spacers fixed between the top plate and bottom plate. Accordingly, producing wood pallets in large quantities requires large quantities of wood by cutting trees, which raises concerns for destruction of tropical forests and other resources that must be protected and thus presents problems from the viewpoint of conservation of trees and protection of the global environment. Also, wood will deteriorate by various types of injurious insects attached thereto if used as is, so wood pallets are sprayed with powerful insecticides to keep away such injurious insects, and the toxicity of these insecticides is creating an issue in countries around the world.

On the other hand, pallets made of synthetic resin have been conventionally proposed and manufactured in different varieties to replace wood pallets. However, conventional synthetic resin pallets are manufactured by means of injection molding using metal dies, which requires expensive molding metal dies to be produced for use in the manufacturing of pallets, and this production cost of metal dies has been a cause of higher prices of synthetic resin pallets.

Additionally, a cardboard cargo pallet that can be manufactured with ease using cardboard, without using wood, has been proposed in Patent Literature 1 mentioned below. This cardboard cargo pallet is manufactured by producing a top plate, a bottom plate, and spacers between the top plate and bottom plate using cardboard, and then combining these members into the shape of a pallet and bonding them together.

Background Art Literatures

[Patent Literature 1] Japanese Patent Laid-open No. Hei 8-175544

SUMMARY

Nevertheless, cardboard pallets are formed using cardboard paper, which has benefit in that they can be manufactured at affordable cost with ease; however, this also presents inevitable problems such as that, when used in an environment where they are readily exposed to rainwater or water or in a very humid environment, these pallets deteriorate easily and reach their end of life quickly.

The present invention aims to solve the aforementioned problems, and its object is to provide a cargo pallet that can be manufactured easily, efficiently, and at affordable cost without using metal dies or any other expensive equipment.

Any discussion of problems and solutions involved in the related art has been included in this disclosure solely for the purposes of providing a context for the present invention, and should not be taken as an admission that any or all of the discussion were known at the time the invention was made.

The cargo pallet proposed by the present invention is a cargo pallet made of synthetic resin, comprising a top plate and a bottom plate formed by cutting synthetic-resin boards to a specified shape and size, as well as spacers fixed between the top plate and the bottom plate, wherein the cargo pallet is characterized in that: the top plate and the bottom plate are each formed by stacking and bonding multiple synthetic-resin boards in such a way that a cavity layer is interposed between two sheets; and as the spacers, elastic spacers made of synthetic resin and having spring elasticity in a height direction are bonded between the top plate and bottom plate. In some embodiments, each board is a corrugated board, and the cavity layer is constituted by ribs connecting the two sheets of each board, wherein the ribs of one board extend in a same direction and are aligned in parallel in a first direction, and the ribs of another board stacked on the one board extend in a same direction and are aligned in parallel in a second direction which is perpendicular to the first direction. That is, the ribs erected between liners of the boards run at right angles to each other. In other embodiments, each board is a honeycomb board, and the cavity layer is constituted by a honeycomb structure.

The top plate and the bottom plate are arranged in parallel and separated by the spacers which are provided therebetween and adhere to both an inner surface of the top plate and an inner surface of the bottom plate. The spacers can function as vibration absorbers. In some embodiments, the cargo pallet is made of synthetic resin without using paper material. In this disclosure, the term "corrugated" refers to "ribbed" or "having corrugations" wherein "corrugation" is not limited to a wavy surface but includes a ribbed structure where two sheets are bonded by ribs running in parallel at intervals between the two sheets. Further, in this disclosure, the term "honeycomb" refers to a structure of adjoining cavities or cells, typically but unnecessarily a structure of hexagonal cells, each cell having a hexagonal cross section taken in parallel to the plate. In some embodiments, a corrugated board and a honeycomb board can be stacked.

This cargo pallet according to some embodiments of the present invention, whose key members being the top plate and bottom plate are formed by a stack of synthetic-resin corrugated boards, with the elastic spacers also made of synthetic resin, offers high water resistance and permits hygienic use, and it is lightweight, has sufficient rigidity, and can be manufactured at affordable cost. Additionally, bonding of the elastic spacers between the top plate and bottom plate ensures that, when the cargo pallet is transported on a vehicle, etc., with articles placed on top, the elastic spacers can absorb the vibration transmitted from the vehicle, etc., and reduce the vibration applied to the articles.

Here, the elastic spacers can be formed in a circular or square cylinder shape having an accordion part made of synthetic resin. This way, any commonly manufactured, general-purpose synthetic resin accordion material of circular or square cylinder shape can be used to manufacture the elastic spacers at affordable cost without using dedicated metal dies, etc. Also, use of the elastic spacers having an accordion part made of synthetic resin means that the vibration transmitted to the top plate from the transportation vehicle, etc., can be absorbed in a favorable manner.

Here, the elastic spacers can also have a cap-shaped cover installed on top in such a way that it covers the accordion part made of synthetic resin until midway from the top. This way, lateral swaying caused by the elastic spacers can be prevented, even when the top plate and articles placed on top sway laterally, because the cap-shaped cover is installed on the accordion part in a manner covering the according part until midway from the top.

Here, the bonding of the stacked synthetic-resin boards, as well as the bonding of the elastic spacers with the top plate and bottom plate, can be achieved using synthetic resin adhesive or by means of heat sealing. This way, cargo pallets of various shapes and sizes can be manufactured in small lots, without equipment cost, by a small number of operators with ease.

Another cargo pallet proposed by the present invention is a cargo pallet made of synthetic resin, comprising a top plate formed by cutting synthetic-resin boards to a specified shape and size, as well as spacers fixed on the bottom face of the top plate, wherein such cargo pallet is characterized in that: the top plate is formed by stacking and bonding multiple synthetic-resin boards in such a way that the ribs erected between the liners of the boards run at right angles to each other; and as the spacers, elastic spacers made of synthetic resin and having spring elasticity in the height direction are bonded to the bottom face of the top plate.

This cargo pallet proposed by the present invention, whose key member being the top plate is formed by a stack of synthetic-resin boards, with the elastic spacers also made of synthetic resin, just like the cargo pallet mentioned earlier, offers high water resistance and permits hygienic use, and it is lightweight, has sufficient rigidity, and can be manufactured at affordable cost.

Additionally, bonding of the elastic spacers on the bottom face of the top plate ensures that, when the cargo pallet is transported on a vehicle, etc., with articles placed on top, the elastic spacers can absorb the vibration transmitted from the vehicle, etc., and reduce the vibration applied to the articles.

According to the cargo pallet proposed by the present invention, a cargo pallet can be manufactured easily, efficiently and at affordable cost without using metal dies or any other expensive equipment.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
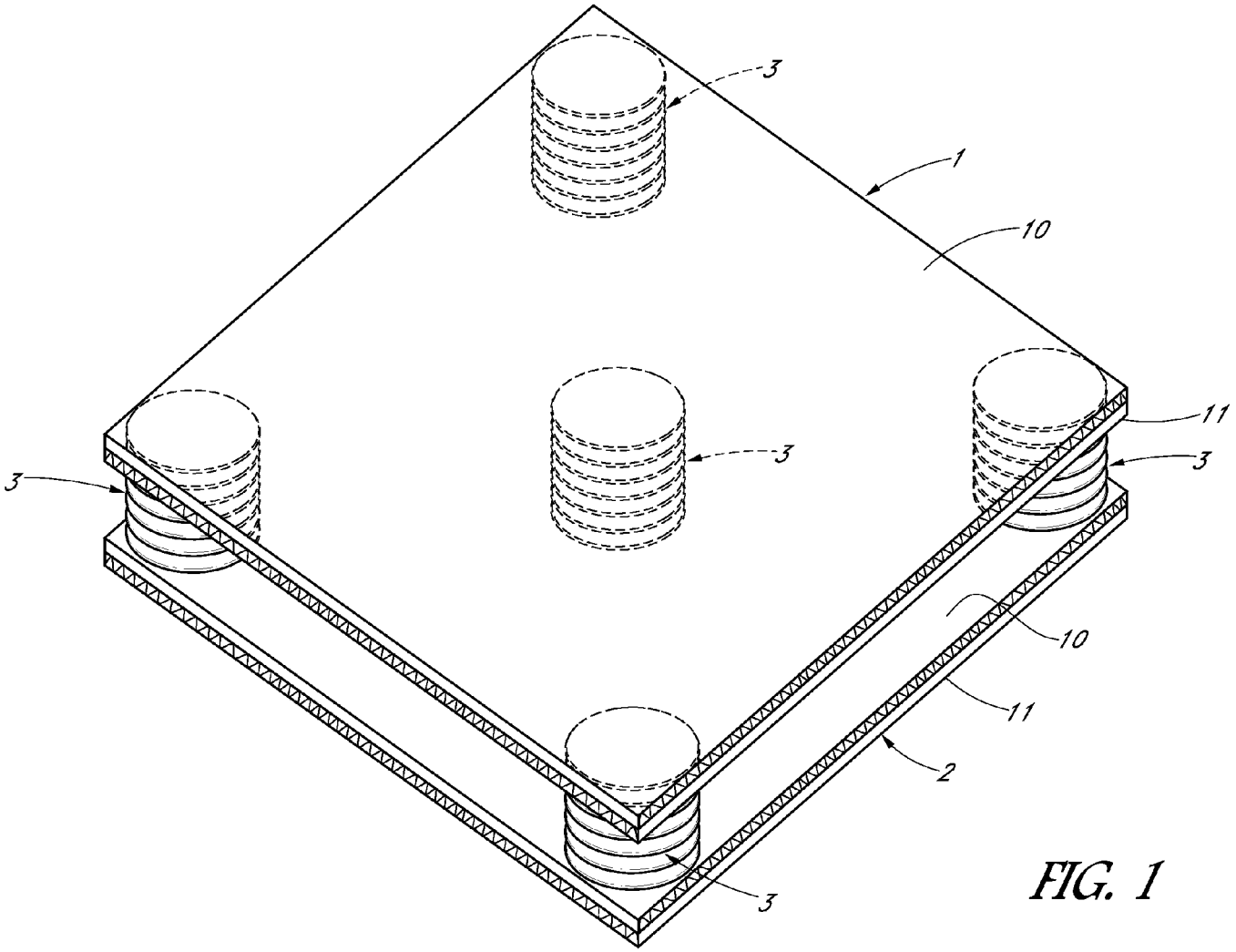
FIG. 1 shows a perspective view of a cargo pallet according to an embodiment of the present invention.

1 Top plate
2 Bottom plate
3 Elastic spacer
4 Cap-shaped cover
5 Accordion part
10 Synthetic-resin corrugated board
11 Synthetic-resin corrugated board
13 Elastic spacer
15 Accordion part
20 Upper liner
21 Lower liner
22 Rib
23 Hollow part
120 Upper liner
121 Lower liner
122 Rib
123 Hollow part

DETAILED DESCRIPTION OF EMBODIMENTS

An embodiment of the present invention is explained below using drawings. This cargo pallet, as shown in FIG. 1, is a cargo pallet made of synthetic resin, comprising a top plate 1 and a bottom plate 2 made of synthetic-resin corrugated boards 10, 11, as well as elastic spacers 3 made of synthetic resin that are inserted and fixed between the top plate 1 and bottom plate 2, wherein such cargo pallet can be manufactured easily and is structured in such a way that the vibration applied to the articles placed and transported on the top plate 1 is absorbed effectively by the elastic spacers 3.

Figure 6:
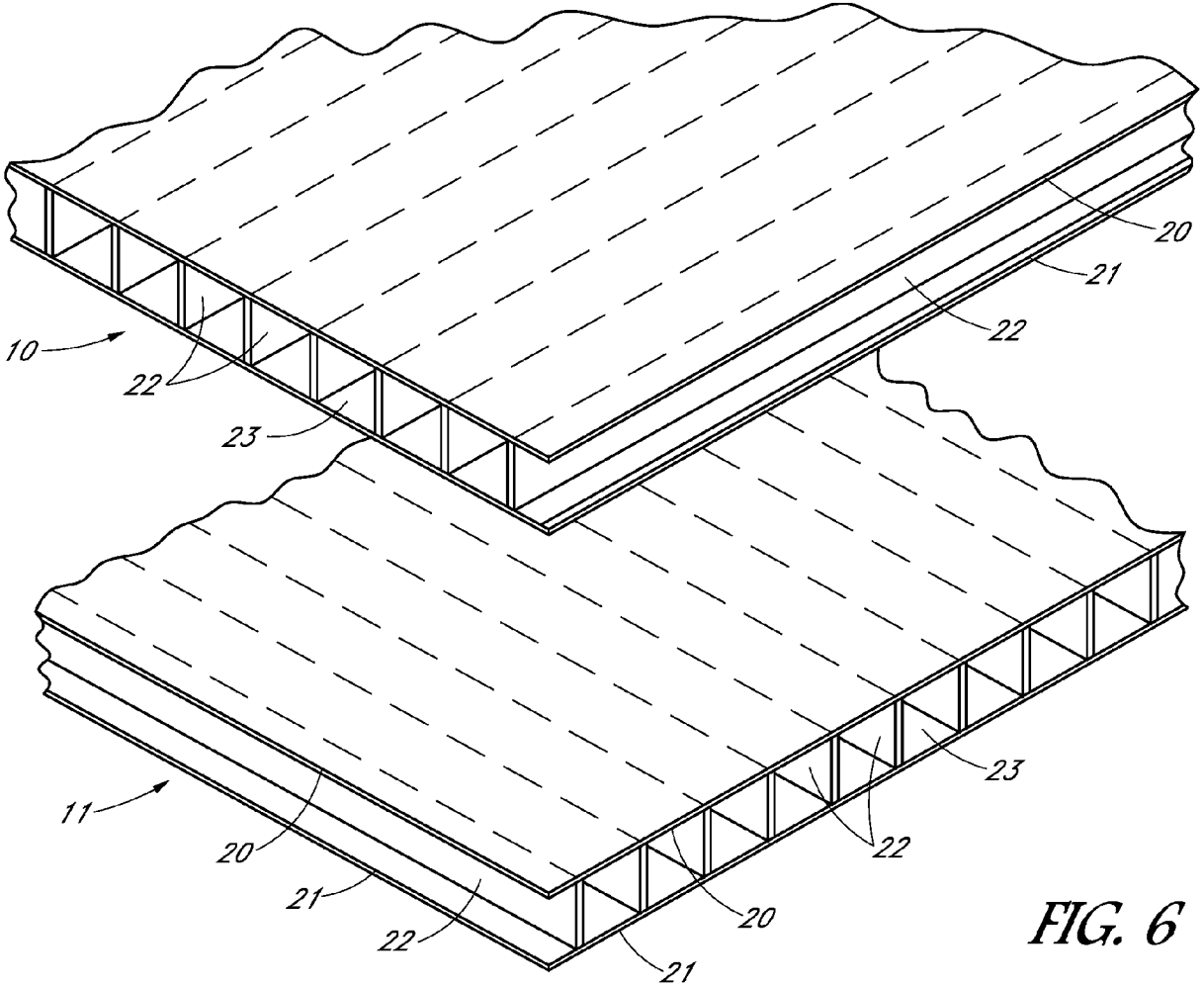
FIG. 6 shows a partial perspective view showing how two synthetic-resin corrugated boards are attached together as the top plate and bottom plate, respectively, according to an embodiment of the present invention.

The synthetic-resin corrugated boards 10, 11 constituting the top plate 1 and bottom plate 2 are each structured in such a way that, as shown in FIG. 6, many ribs 22 are erected at intervals between liners 20, 21 (sheet-shaped parts) placed on top and bottom, with hollow spaces 23 formed inside.

Also, as shown in FIG. 6, the top plate 1 and bottom plate 2 are each made of two synthetic-resin corrugated boards 10, 11 that are oriented and stacked so that their ribs 22 run at right angles to each other and then are bonded together as such. By stacking and bonding together two synthetic-resin corrugated boards 10, 11 so that their ribs 22 run at right angles to each other, the bending strength of the top plate 1 and bottom plate 2 can be increased.

It should be noted that, to increase the bending strength of the top plate 1 and bottom plate 2 further, three or four synthetic-resin corrugated boards can be stacked and bonded together. In this case, too, the multiple synthetic-resin corrugated boards are stacked and bonded together in such a way that the ribs on the inner side are oriented to run at right angles to each other.

These synthetic-resin corrugated boards 10, 11 are formed by means of integral extrusion molding using synthetic resin material such as polypropylene, polycarbonate, etc. Therefore, board manufacturers can produce synthetic-resin corrugated boards in large quantities using relatively simple equipment, and currently synthetic-resin corrugated boards of various sizes and shapes are available on the market at affordable prices. Accordingly, synthetic-resin corrugated boards of various sizes and shapes can be obtained easily for use in the manufacture of cargo pallets, where any commercially available synthetic-resin corrugated boards can be cut and used easily as the synthetic-resin corrugated boards 10, 11 from which to make pallets.

Also, used polypropylene, polycarbonate, and other thermoplastic synthetic resin materials can be cut into chips and melted by heat to be reused as recycled plastic material, and using synthetic-resin corrugated boards made of such recycled plastic material is ideal from the viewpoint of conserving resources.

As shown in FIG. 1, four elastic spacers 3 are inserted and fixed, at roughly the four corners, between the top plate 1 and bottom plate 2, each formed by stacking and bonding together two synthetic-resin corrugated boards 10, 11, with the top face and bottom face of each elastic spacer 3 bonded and fixed to the bottom face of the top plate 1 and the top face of the bottom plate 2, respectively. This bonding can be easily achieved using synthetic resin adhesive, heat sealing, or double-sided adhesive tape, etc.

Figure 11:
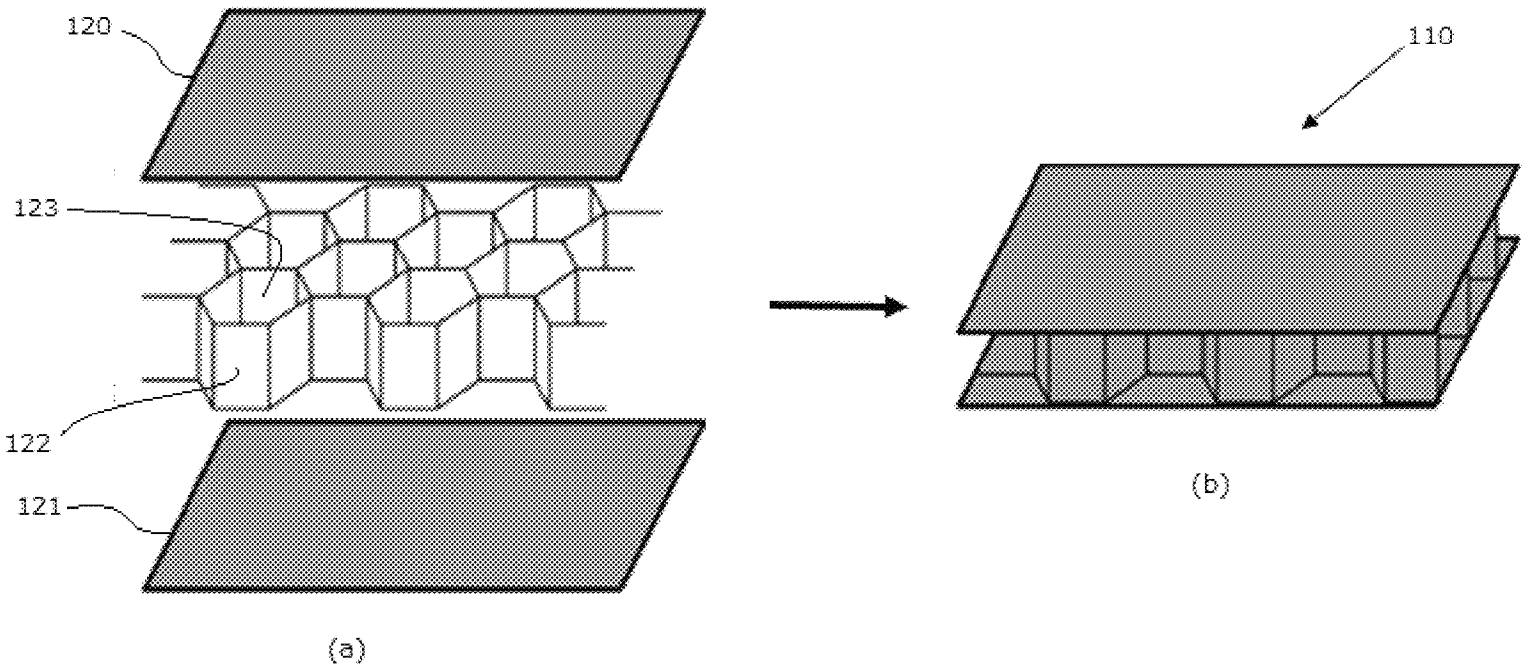
FIG. 11 shows partial perspective views of a synthetic-resin corrugated board, wherein (a) is an exploded view, and (b) is a completion view according to an embodiment of the present invention.

In other embodiments, as shown in FIG. 11, the synthetic-resin board is a honeycomb board 110 (as illustrated in (b)) constituting the top plate 1 and/or bottom plate 2, which honeycomb board is structured in such a way that a structure of adjoining cells 122 (the structure replaces the ribs shown in FIG. 6, for example) is interposed between upper and lower liners 120, 121 (sheet-shaped parts) and bond the liners, wherein hollow spaces or cavities 123 are formed inside as illustrated in (a).

Figure 3:
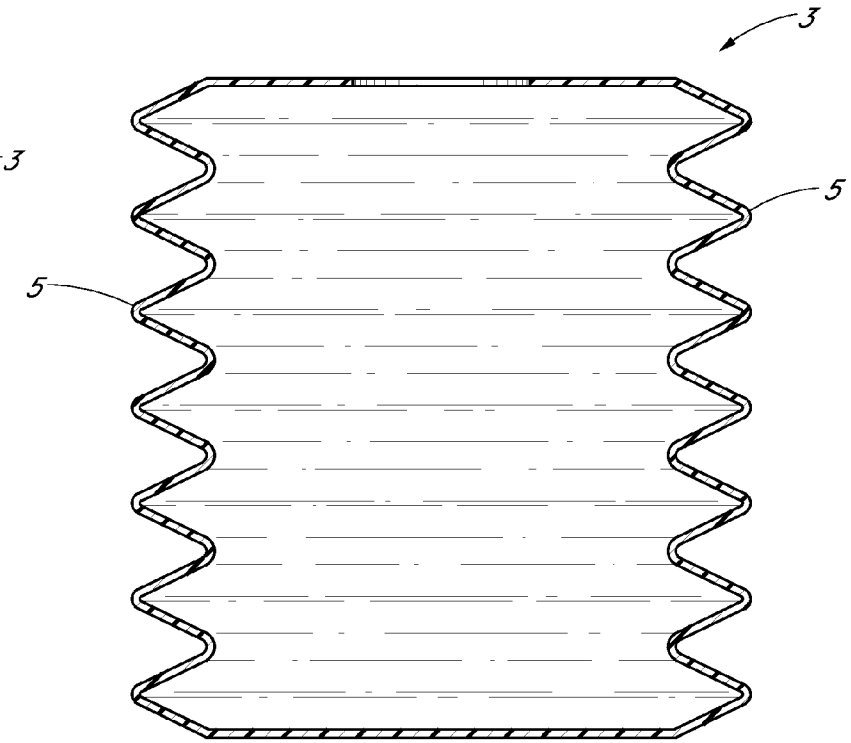
FIG. 3 shows a longitudinal section view of the elastic spacer.
Figure 2:
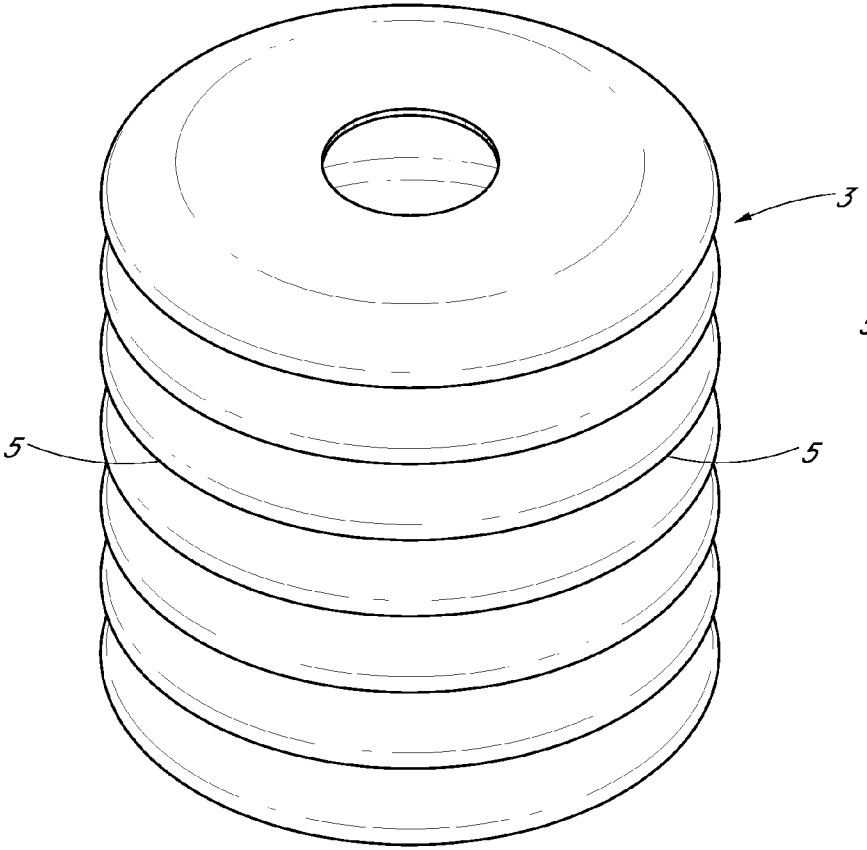
FIG. 2 shows a perspective view of an elastic spacer used on the cargo pallet according to an embodiment of the present invention.

As shown in FIGS. 2, 3, the elastic spacer 3 is formed by synthetic resin in the shape of a circular cylinder, with an accordion part 5 made of synthetic resin provided as the circular cylinder wall. Because of this accordion part 5, the elastic spacer 3 has appropriate spring elasticity in the vertical direction (height direction). The flat bottom face of the elastic spacer 3 of circular cylinder shape is closed, while an opening is formed in the flat top face which is created at the time of molding.

This means that, when inserting and bonding the elastic spacer 3 between the top plate 1 and bottom plate 2, the elastic spacer 3 can be bonded easily between the top plate 1 and bottom plate 2 of the synthetic-resin corrugated board by applying adhesive on the top face and bottom face of the elastic spacer 3 or by means of heat sealing.

Such elastic spacer 3 having the accordion part 5 can be manufactured relatively easily by blow molding, etc., using vinyl chloride resin or other synthetic resin material, and currently this type of accordion part 5 is manufactured in many varieties for general purposes such as elastic members for manual air pumps, flexible covers for bending parts, and the like. Accordingly, these general-purpose accordion members made of synthetic resin can be used directly as the elastic spacers 3 and they can be obtained at relatively affordable cost.

Figure 5:
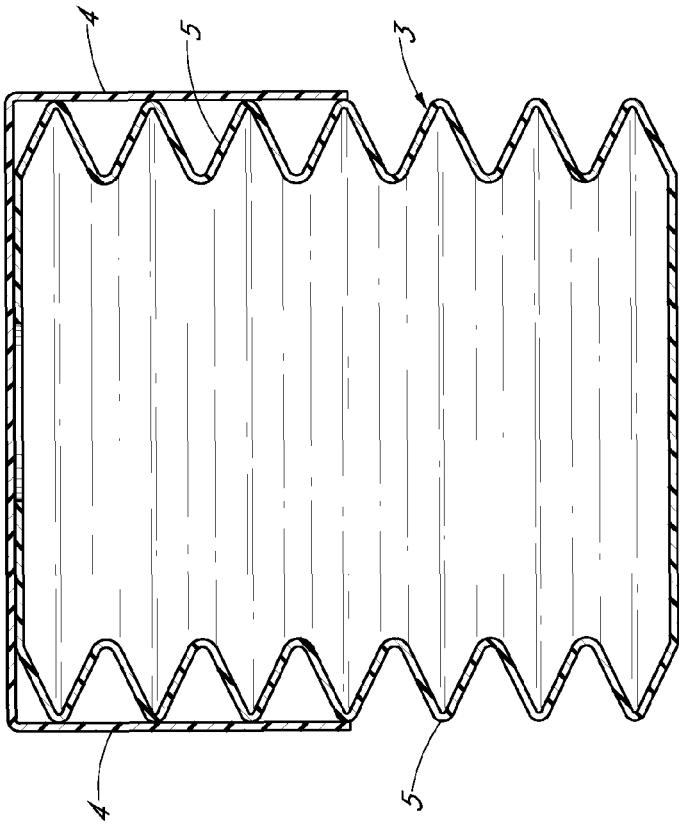
FIG. 5 shows a longitudinal section view of the elastic spacer with the cap-shaped cover.
Figure 4:
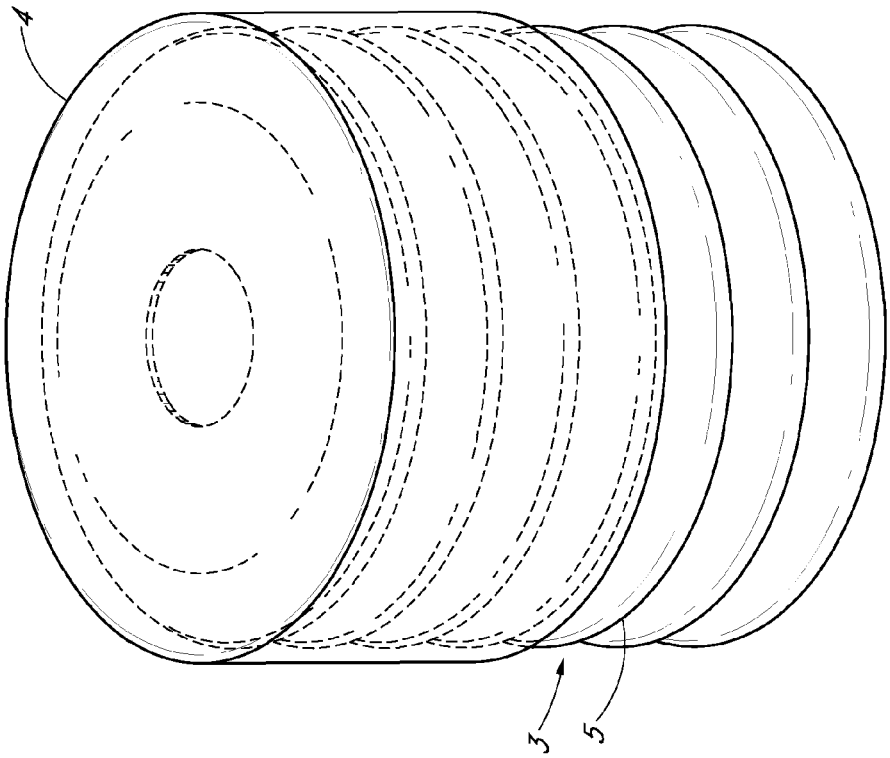
FIG. 4 shows a perspective view of the elastic spacer with a cap-shaped cover installed on top according to an embodiment of the present invention.

As shown in FIGS. 4, 5, preferably the elastic spacer 3 with the accordion part 5 has a cap-shaped cover 4 placed and fixed on top. As shown in FIGS. 4, 5, the cap-shaped cover 4 is formed in the shape of a circular cylinder whose top face is closed, where its inner diameter is formed slightly larger than the outer diameter of the elastic spacer 3. The cap-shaped cover 4 is loosely placed on the accordion part 5 at the top of the elastic spacer 3, and the inside bottom face of the cap-shaped cover 4 is bonded to the top face of the elastic spacer 3. Accordingly, when the elastic spacer 3 with the cap-shaped cover 4 as shown in FIGS. 4, 5 is used, the top face of this cap-shaped cover 4 is bonded to the bottom face of the top plate 1.

When manufacturing the cargo pallet of the aforementioned constitution, an assembly jig of simple structure is placed on a manufacturing work bench and the pallet can be manufactured easily by hand on the assembly jig.

The assembly jig is formed by a square baseboard of roughly the same size as or slightly larger size than the top plate 1 and bottom plate 2, with positioning walls erected at the four corners. By producing multiple assembly jigs according to the shapes and sizes of the cargo pallets to be manufactured (shapes and sizes of the top plate 1 and bottom plate 2), various types of cargo pallets can be manufactured easily using the assembly jigs of respective sizes.

To manufacture the cargo pallet using such jig, first, two synthetic-resin corrugated boards 10, 11 that have been cut to a specified shape are placed on the assembly jig (inside of the positioning walls at the four corners), and the two synthetic-resin corrugated boards 10, 11 are bonded by applying adhesive between them or heat-sealing the two. It should be noted that the bonding of the synthetic-resin corrugated boards 10, 11 and bonding of the elastic spacers 3 can also be achieved using double-sided adhesive tape besides using adhesive or heat sealing.

At this time, the two synthetic-resin corrugated boards 10, 11 are oriented and stacked in such a way that their respective ribs 22 run at right angles to each other, and are bonded together as such. The top plate 1 and bottom plate 2 are each formed by stacking and bonding together two synthetic-resin corrugated boards 10, 11 this way.

Next, the bottom plate 2 produced above is placed on the assembly jig and the elastic spacers 3 coated with adhesive are placed at the four corners of the bottom plate, after which the top plate 1 is placed on top and the top faces of the elastic spacers 3 are bonded to the bottom face of the top plate 1. This way, assembly of the cargo pallet is completed easily and quickly.

As described above, cargo pallet manufacturers or businesses that use cargo pallets to transport articles can manufacture cargo pallets of various sizes and shapes with ease according to the sizes and shapes of the products to be transported. In other words, the synthetic-resin corrugated boards, elastic spacers, and assembly jigs as described above are all that are needed to manufacture cargo pallets with ease according to the sizes and shapes of the products to be transported, for use in the transporting of products.

When in use for the purpose of transporting, the cargo pallet carries electrical products or other articles to be transported on top, and because the key members being the top plate 1 and bottom plate 2 are formed by a stack of synthetic-resin corrugated boards 10, 11, with the elastic spacers 3 also made of synthetic resin, the pallet offers high water resistance and permits hygienic use. Additionally, the synthetic-resin corrugated boards 10, 11 and elastic spacers 3 have hollow parts and are thus lightweight but are formed with sufficient rigidity, so the pallet can be used easily and conveniently for cargo handling.

Furthermore, bonding of the elastic spacers 3 between the top plate 1 and bottom plate 2 ensures that, when the cargo pallet is transported on a vehicle, etc., with electrical products or other articles to be transported placed on top, the elastic spacers 3 can absorb the vibration transmitted from the vehicle, etc., and reduce the vibration applied to the electrical products or other articles to be transported.

It should be noted that, although the elastic spacers 3 contract by receiving the load of the articles transported and the distance between the top plate 1 and bottom plate 2 becomes shorter as a result, this does not present operational problems so long as this distance is enough to insert the forks of a forklift in between. Also, as shown in FIGS. 4, 5, installation and use of the cap-shaped covers 4 on top of the elastic spacers 3 allows the cap-shaped covers 4 to prevent lateral swaying from generating due to the elastic spacers 3 during transport. Also, when the elastic spacers 3 contract by receiving the load of the articles transported, the maximum contraction band is limited by the height dimension of the cap-shaped cover 4, which inevitably ensures a space of specific height between the top plate 1 and bottom plate 2.

As described above, the aforementioned cargo pallet, because its key members being the top plate 1 and bottom plate 2 are formed by a stack of synthetic-resin corrugated boards 10, 11, with the elastic spacers 3 also made of synthetic resin and formed in a circular cylinder shape, offers high water resistance and permits hygienic use, while the top plate 1, bottom plate 2, and elastic spacers 3 are lightweight, have sufficient rigidity, and can be manufactured at affordable cost. Also, bonding of the elastic spacers 3 between the top plate 1 and bottom plate 2 ensures that, when the cargo pallet is transported on a vehicle, etc., with articles placed on top, the elastic spacers 3 can absorb the vibration transmitted from the vehicle, etc., and reduce the vibration applied to the articles.

Figure 7:
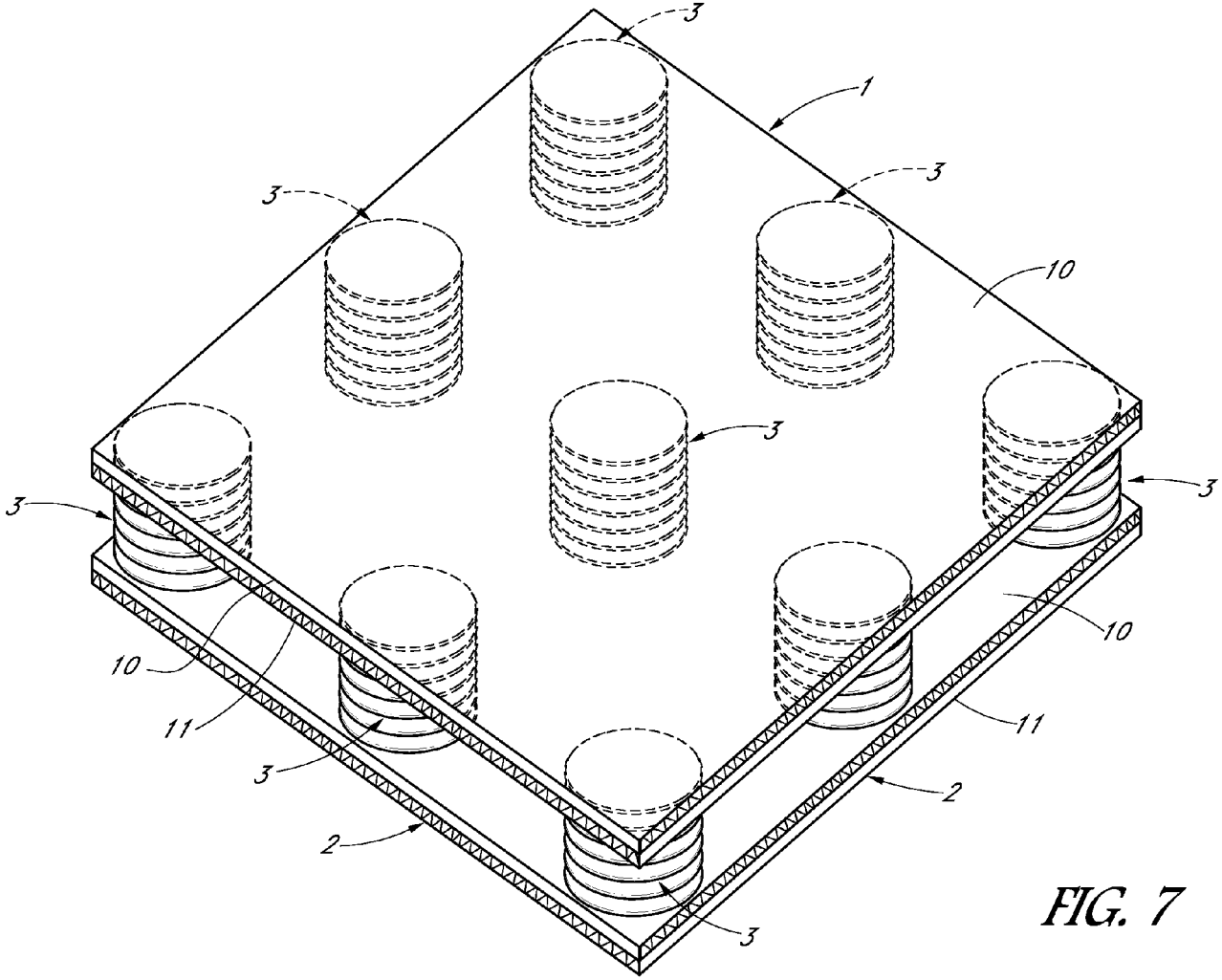
FIG. 7 shows a perspective view showing an example where eight elastic spacers are inserted between the top plate and bottom plate.

FIG. 7 shows another embodiment of the cargo pallet, and in this embodiment, nine elastic spacers 3 are inserted and bonded between the top plate 1 and bottom plate 2. As shown in FIG. 7, the nine elastic spacers 3, including one placed at the center, four placed at the four corners of the top plate 1 and bottom plate 2, and the remaining four placed each at the center on each side (center between the two corners), are bonded at their top face and bottom face. It should be noted that, as shown in FIGS. 4, 5, elastic spacers 3 each with a cap-shaped cover 4 placed on top can be used for the elastic spacers 3 of the cargo pallet shown in FIG. 7.

As described above, the cargo pallet, shaped in such a way that the nine elastic spacers 3 are inserted and bonded between the top plate 1 and bottom plate 2, is suitable for placing and transporting heavier articles compared to the cargo pallet using four elastic spacers 3 as mentioned earlier, because the load of the articles transported which are placed on the top plate 1 can be distributed and received by the nine elastic spacers 3.

Figure 8:
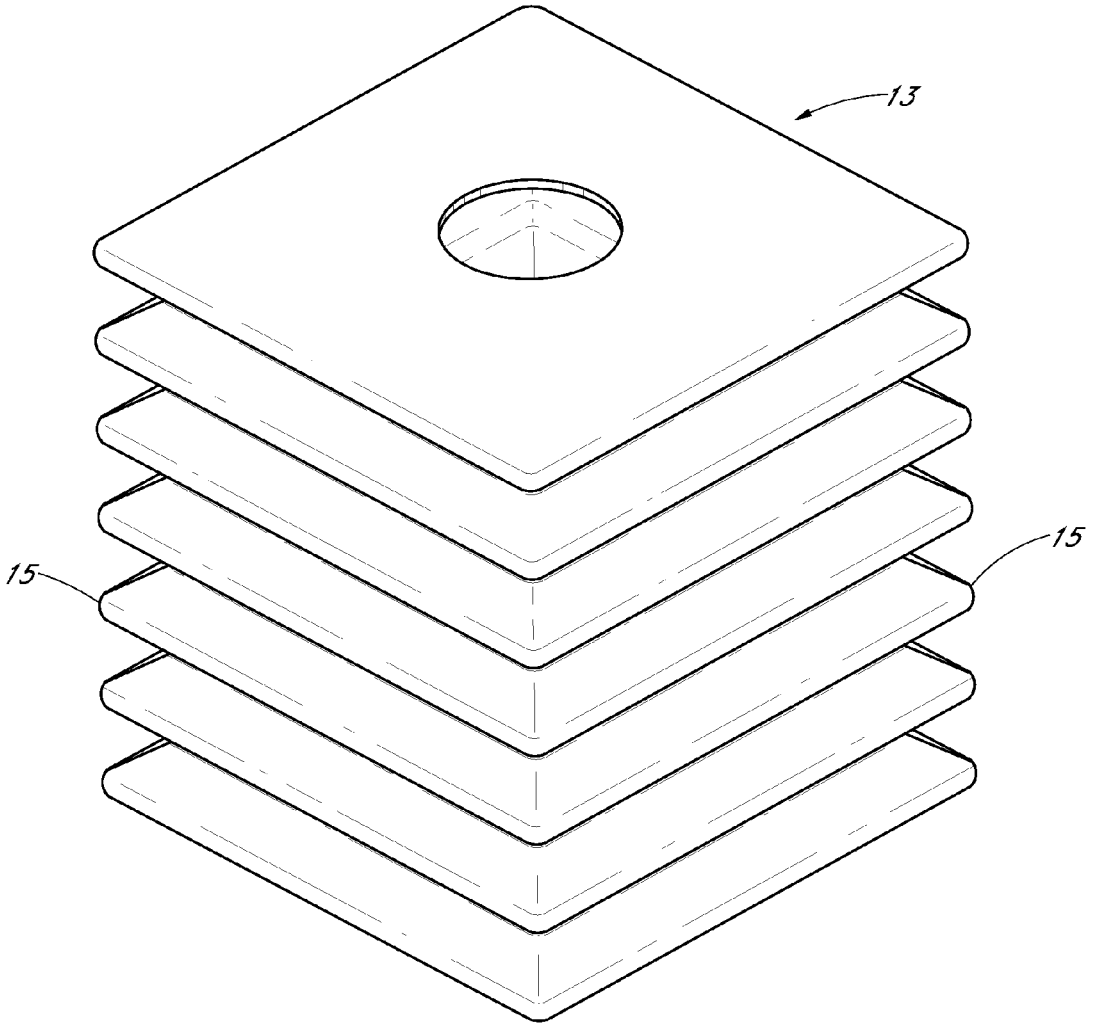
FIG. 8 shows a perspective view of an elastic spacer of square cylinder shape according to an embodiment of the present invention.

FIG. 8 shows an elastic spacer 13 of square cylinder shape, and this elastic spacer 13 of square cylinder shape can be used in place of the aforementioned elastic spacer 3 of circular cylinder shape. The elastic spacer 13 of square cylinder shape is made of synthetic resin, has a top face and a bottom face formed roughly as a square, and an accordion part 15 of square cylinder shape is provided on the outer periphery. Because of this, the elastic spacer 13 of square cylinder shape has appropriate spring elasticity in the vertical direction (height direction), just like the aforementioned elastic spacer 3 of circular cylinder shape.

The flat bottom face of the elastic spacer 13 is closed, while the flat top face has an opening formed in it at the time of molding, as shown in FIG. 8. Accordingly, these elastic spacers 13 of square cylinder shape, too, can have the same function of absorbing vibration, etc., as mentioned above, when inserted and bonded between the top plate 1 and bottom plate 2 to form the cargo pallet.

It should be noted that, in place of the aforementioned elastic spacers 3, 13, another constitution is possible where elastic spacers having spring elasticity in the vertical direction are formed by bending plastic board and these elastic spacers are installed between the top plate 1 and bottom plate 2.

Figure 9:
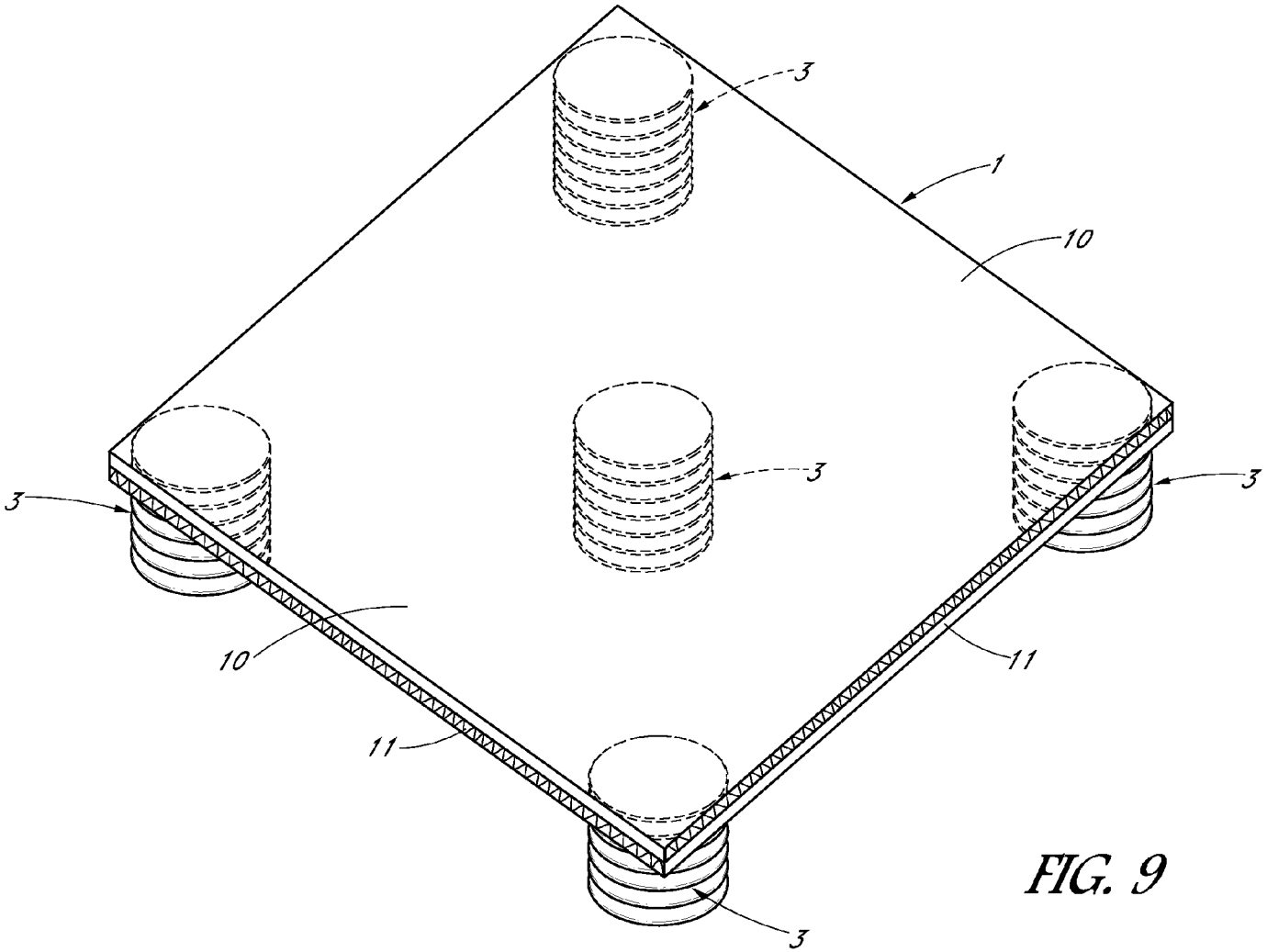
FIG. 9 shows a perspective view of a cargo pallet according to another embodiment of the present invention.
Figure 10:
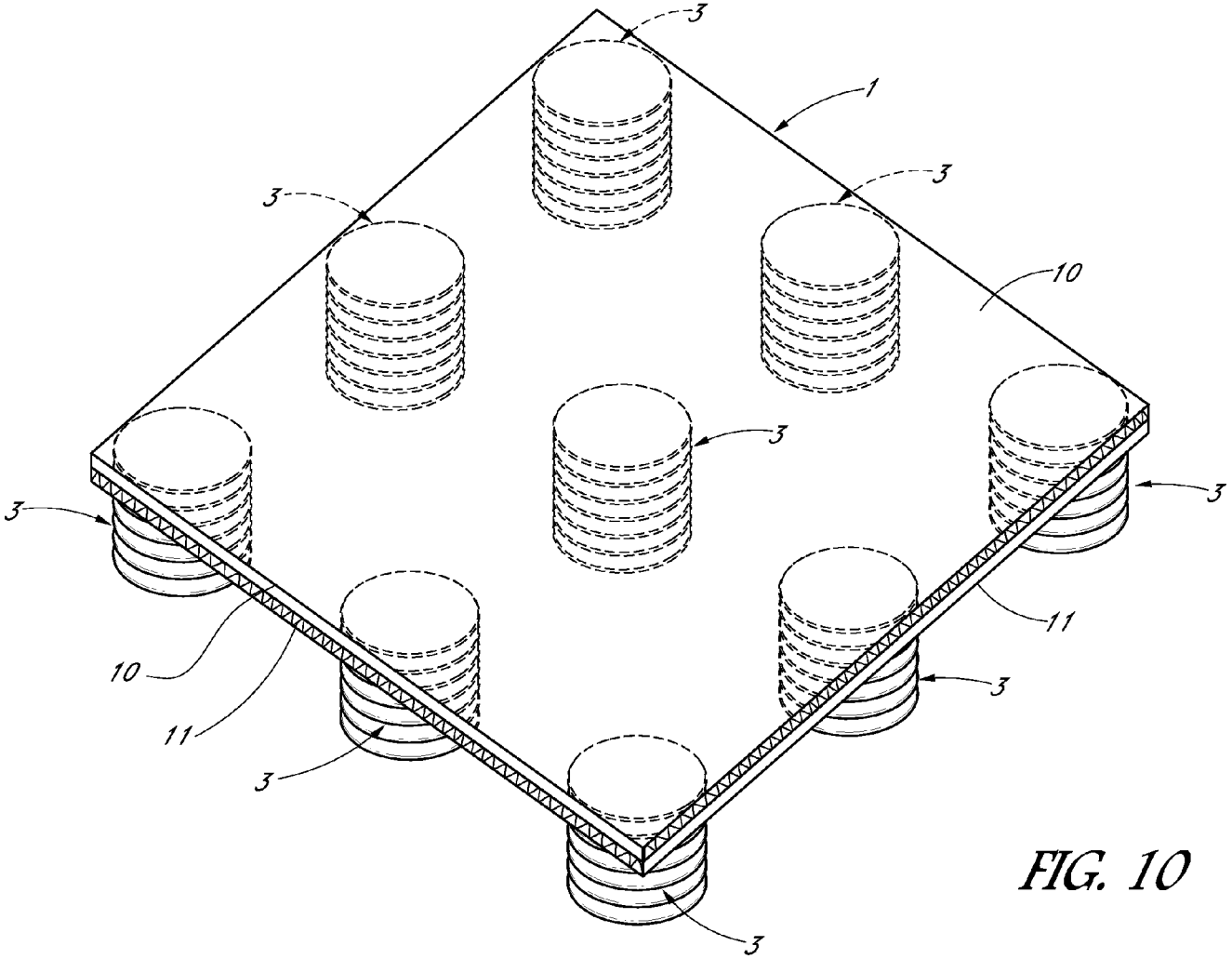
FIG. 10 shows a perspective view of a cargo pallet according to another embodiment of the present invention.

FIGS. 9, 10 show a cargo pallet representing yet another embodiment. The parts that are the same as in the aforementioned embodiments are denoted using the same symbols in the figures and are not explained.

To be specific, the cargo pallet shown in FIGS. 9, 10 is a simple pallet having only the top plate 1 and no bottom plate, where the top plate 1 is formed by synthetic-resin corrugated boards 10, 11 in the same manner as explained above. And, elastic spacers 3 made of synthetic resin are bonded at the center and four corners of the bottom face of the top plate 1 shown in FIG. 9. Also, nine elastic spacers 3 made of synthetic resin are bonded at the center, four corners, and center on each side (center between the two corners) of the bottom face of the top plate 1 shown in FIG. 10.

It should be noted that, also for the elastic spacers 3 used here, elastic spacers 3 each made by placing the aforementioned cap-shaped cover 4 loosely on the accordion part 5 at the top of an elastic spacer 3 and then bonding the inside bottom face of the cap-shaped cover 4 to the top face of the elastic spacer 3, can be used. Furthermore, elastic spacers 13 of square cylinder shape as shown in FIG. 8 can be used in place of the elastic spacers 3 of circular cylinder shape.

The top plate 1 is formed by two synthetic-resin corrugated boards 10, 11 that are oriented and stacked in such a way that their respective ribs 22 run at right angles to each other, and are bonded together as such. By stacking and bonding together two synthetic-resin corrugated boards 10, 11 so that their ribs run at right angles to each other, the bending strength of the top plate 1 is increased. It should be noted that, to further increase the bending strength of the top plate 1, three or four synthetic-resin corrugated boards can be stacked and bonded together.

This cargo pallet, whose key member being the top plate 1 is formed by a stack of synthetic-resin corrugated boards 10, 11, with the elastic spacers 3 also made of synthetic resin, offers high water resistance and permits hygienic use, and it is lightweight, has sufficient rigidity, and can be manufactured at affordable cost. Furthermore, bonding of the elastic spacers 3 to the bottom face of the top plate 1 ensures that, when the cargo pallet is transported on a vehicle, etc., with articles to be transported placed on top, the elastic spacers 3 with the accordion parts 5 can absorb the vibration transmitted from the vehicle, etc., and reduce the vibration applied to the articles.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2015-205001, filed Oct. 16, 2015, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A cargo pallet made of synthetic resin, comprising:

a top plate and a bottom plate, each plate constituted by bonded stacked synthetic-resin boards cut into a specified shape and size, each board being constituted by two sheets bonded by an inner cavity layer disposed between the two sheets; and spacers bonded between the top plate and the bottom plate which are arranged in parallel and separated by the spacers, said spacers being elastic spacers made of synthetic resin and having spring elasticity in a height direction, wherein the elastic spacers are formed in a circular or square cylinder shape having an accordion part made of synthetic resin.

2. The cargo pallet according to claim 1, wherein the elastic spacers have a cap-shaped cover installed on top in such a way that it covers the accordion part made of synthetic resin until midway from the top.

3. The cargo pallet according to claim 1, wherein each board is a corrugated board, and the cavity layer is constituted by ribs connecting the two sheets of each board, wherein the ribs of one board extend in a same direction and are aligned in parallel in a first direction, and the ribs of another board stacked on the one board extend in a same direction and are aligned in parallel in a second direction which is perpendicular to the first direction.

4. The cargo pallet according to claim 1, wherein each board is a honeycomb board, and the cavity layer is constituted by a honeycomb structure.

5. The cargo pallet according to claim 1, wherein the bonding of the stacked synthetic-resin boards, and the bonding of the elastic spacers with the top plate and the bottom plate are constituted by a synthetic resin adhesive or by heat sealing.

6. A cargo pallet made of synthetic resin, comprising:

a top plate constituted by bonded stacked synthetic-resin boards cut into a specified shape and size, each board being constituted by two sheets with an inner cavity layer disposed between the two sheets; and spacers bonded to a bottom face of the top plate, said spacers being elastic spacers made of synthetic resin and having spring elasticity in a height direction, wherein the elastic spacers are formed in a circular or square cylinder shape having an accordion part made of synthetic resin.

7. The cargo pallet according to claim 6, wherein each board is a corrugated board, and the cavity layer is constituted by ribs connecting the two sheets of each board, wherein the ribs of one board extend in a same direction and are aligned in parallel in a first direction, and the ribs of another board stacked on the one board extend in a same direction and are aligned in parallel in a second direction which is perpendicular to the first direction.

8. The cargo pallet according to claim 6, wherein each board is a honeycomb board, and the cavity layer is constituted by a honeycomb structure.

* * * * *